US010535311B2

(12) United States Patent
Lin

(10) Patent No.: US 10,535,311 B2
(45) Date of Patent: Jan. 14, 2020

(54) DISPLAYING METHOD AND DISPLAYING APPARATUS

(71) Applicant: BENQ CORPORATION, Taipei (TW)

(72) Inventor: Hsin-Nan Lin, Taipei (TW)

(73) Assignee: BenQ Corporation, Taipei (TW)

( * ) Notice: Subject to any disclaimer, the term of this patent is extended or adjusted under 35 U.S.C. 154(b) by 115 days.

(21) Appl. No.: 15/206,324

(22) Filed: Jul. 11, 2016

(65) Prior Publication Data

US 2017/0025073 A1 Jan. 26, 2017

(30) Foreign Application Priority Data

Jul. 24, 2015 (TW) ..... 104123965 A

(51) Int. Cl.
*G09G 3/34* (2006.01)

(52) U.S. Cl.
CPC ... *G09G 3/3406* (2013.01); *G09G 2320/0252* (2013.01); *G09G 2320/0257* (2013.01); *G09G 2320/064* (2013.01)

(58) Field of Classification Search
CPC ..... G09G 3/3406; G09G 2320/0252; G09G 2320/0257; G09G 2320/064; G09G 2320/103
See application file for complete search history.

(56) References Cited

U.S. PATENT DOCUMENTS

2008/0170026 A1* 7/2008 Ishihara ..... G09G 3/3666 345/99
2008/0180385 A1* 7/2008 Yoshida ..... G09G 3/20 345/102

FOREIGN PATENT DOCUMENTS

TW 201044355 A1 12/2010
TW 201108193 A * 3/2011

* cited by examiner

*Primary Examiner* — Stacy Khoo

(57) ABSTRACT

A displaying method for a displaying apparatus having a liquid crystal display panel for displaying images thereon is used for displaying images in accordance with a periodic time sequence. The periodic time sequence includes a plurality of scanning time periods and a plurality of vertical blanking intervals. The scanning time periods and the vertical blanking intervals are staggered. The displaying method includes the steps of: providing a substantially identical frame image data by a control module of the displaying apparatus to the liquid crystal display panel for each scanning time period; and providing a back light by a backlight module of the displaying apparatus to the liquid crystal display panel after an end point of the first one of the scanning time periods. Therein, the back light has a light intensity. Further, the light intensity can be designed to be adjustable.

17 Claims, 7 Drawing Sheets

DISPLAYING METHOD AND DISPLAYING APPARATUS

BACKGROUND OF THE INVENTION

1. Field of the Invention

The invention relates to a displaying method and a displaying apparatus, and especially relates to a hold-type displaying method and a displaying apparatus using the displaying method.

2. Description of the Prior Art

In the configuration of conventional liquid crystal displays, the liquid crystal panel plays a passive role in displaying and cannot display image without back light. However, liquid crystal cells need a time for switching statuses. If the back light is present all the time, the transition of the liquid crystal cells will be observed by users, resulting in a blur. When the display displays dynamic video, blurs occur at the whole frame, which influences the watching of the users. Furthermore, in principle, the liquid crystal displaying is a kind of hold-type displaying technology. If the back light is provided only within intervals between frame scans (i.e. vertical blanking intervals), the blur problem can be eliminated effectively. However, the image brightness will be insufficient, which influences color displaying. Therefore, the conventional liquid crystal displays usually faces the dilemma of image blurs or insufficient brightness.

SUMMARY OF THE INVENTION

An objective of the invention is to provide a displaying method. The displaying method uses repeating scanning within a period and provides a back light, the light intensity of which is adjustable, after the end of the first one scanning time period, for reducing the influence of blurs and solving the problem of insufficient image brightness.

A displaying method according to invention displays images on a liquid crystal display panel of a displaying apparatus in accordance with a periodic time sequence. The displaying apparatus further includes a control module, electrically connected to the liquid crystal display panel, and a backlight module, electrically connected to the control module and disposed adjacent to the liquid crystal display panel. The periodic time sequence includes a plurality of scanning time periods and a plurality of vertical blanking intervals staggered with the scanning time periods. The displaying method includes the following steps: providing a substantially identical frame image data by the control module to the liquid crystal display panel for each scanning time period; and providing a first backlight by the backlight module to the liquid crystal display panel after an end point of the first one of the scanning time periods. The first back light has a light intensity. Further, the light intensity can be designed to be adjustable.

Another displaying method according to invention displays images on a liquid crystal display panel of a displaying apparatus in accordance with a periodic time sequence. The displaying apparatus further includes a control module, electrically connected to the liquid crystal display panel, and a backlight module, electrically connected to the control module and disposed adjacent to the liquid crystal display panel The periodic time sequence includes a first scanning time period, a vertical blanking interval after the first scanning time period, and a second scanning time period after the vertical blanking interval in order. The displaying method includes the following steps: providing a substantially identical frame image data by the control module to the liquid crystal display panel for the first scanning time period and the second scanning time period; and providing a first back light by the backlight module to the liquid crystal display panel after an end point of the first scanning time period. The first back light has a light intensity. The light intensity is adjustable.

Another objective of the invention is to provide a displaying apparatus using the displaying method according to the invention. The displaying apparatus can reduce the influence of blurs and solve the problem of insufficient image brightness by using the displaying method.

A displaying apparatus according to invention displays images in accordance with a periodic time sequence. The periodic time sequence includes a plurality of scanning time periods and a plurality of vertical blanking intervals staggered with the scanning time periods. The displaying apparatus includes a liquid crystal display panel, a backlight module, and a control module. The liquid crystal display panel has a displaying area. The backlight module is disposed adjacent to the liquid crystal display panel. The control module is electrically connected to the liquid crystal display panel and the backlight module. The control module provides a substantially identical frame image data to the liquid crystal display panel for each scanning time period and controls the backlight module to provide a first back light to the liquid crystal display panel after an end point of the first one of the scanning time periods, so as to display an image corresponding to the frame image data on the displaying area. Therein, the first back light has a light intensity, and the light intensity is adjustable.

Compared with the prior art, the displaying method and displaying apparatus according to the invention provides back light after the end of the first one of scanning time periods of a period time sequence in which substantially the same frame image data is repeatedly scanned. During the period time sequence, the frame image data has been scanned completely within the first one of the scanning time periods. There is no change in scanning the frame image data during the following scanning time periods, so providing the back light after the first one of the scanning time periods can reduce the influence of blurs to the user watching displayed images, especially dynamic images. Furthermore, during the same period time sequence, the light intensity of the back light is adjustable, which facilitates compensation on the average brightness of the image so that the colors of the image can be displayed truly. Therefore, the displaying method and displaying apparatus according to the invention can effectively reduce the influence of blurs and solve the problem of insufficient image brightness.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
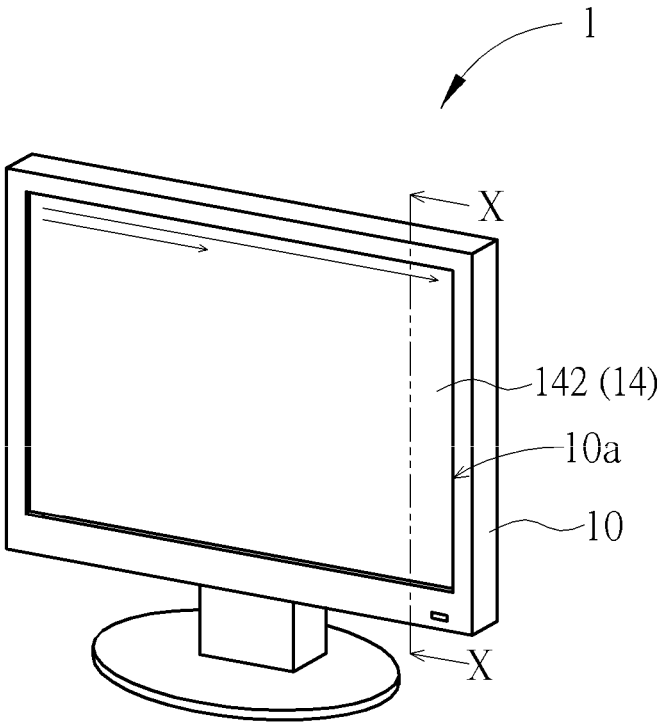
FIG. 1 is a schematic diagram illustrating a displaying apparatus of an embodiment according to the invention.
Figure 2:
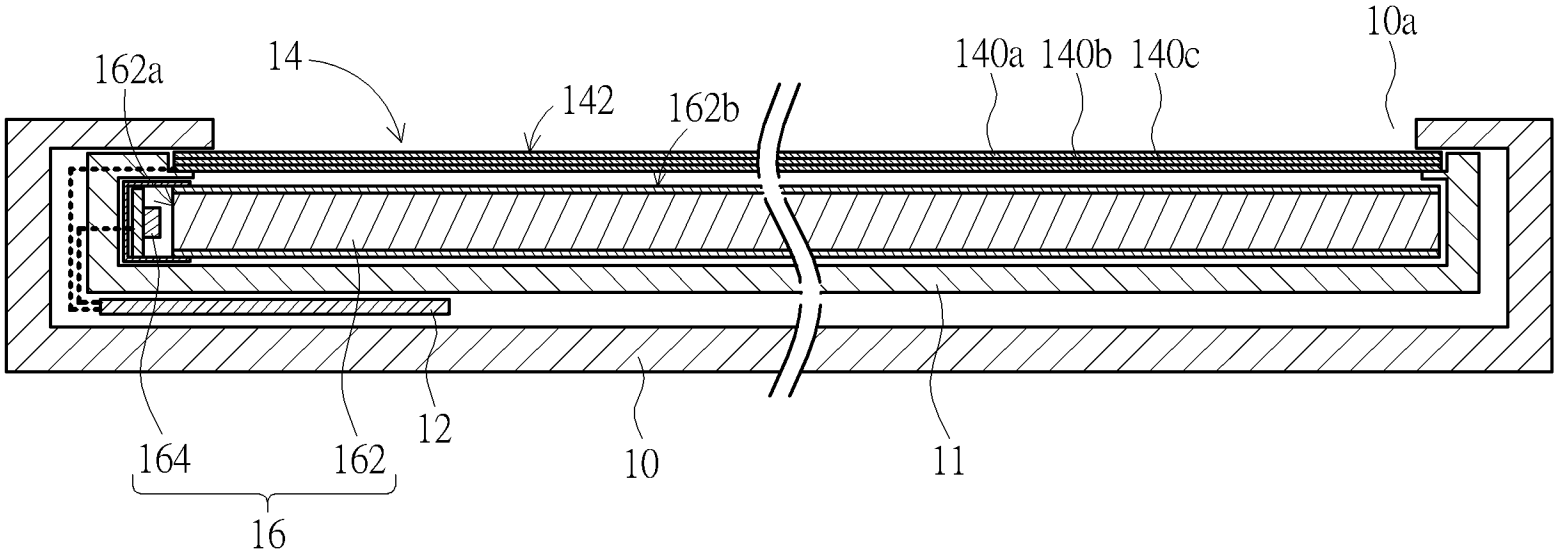
FIG. 2 is a sectional view of the displaying apparatus 1 along the line X-X in FIG. 1.
Figure 3:
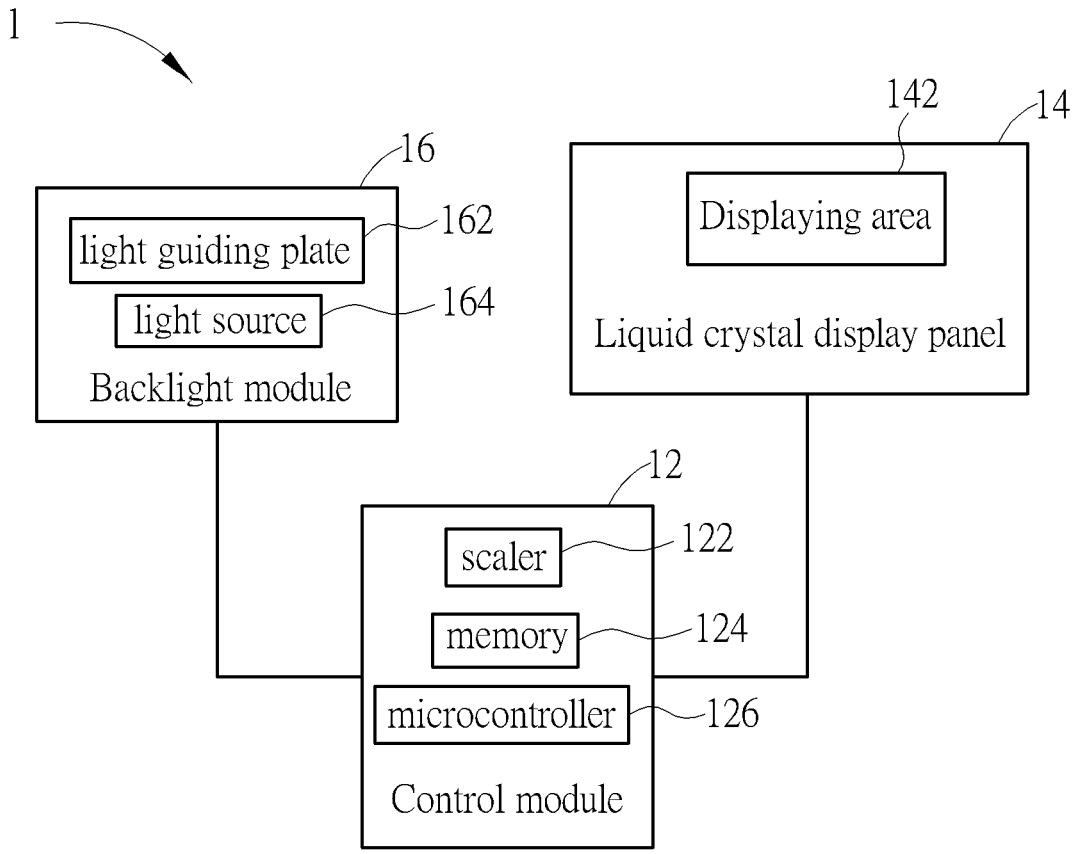
FIG. 3 is a function block diagram of the displaying apparatus according to the invention.
Figure 4:
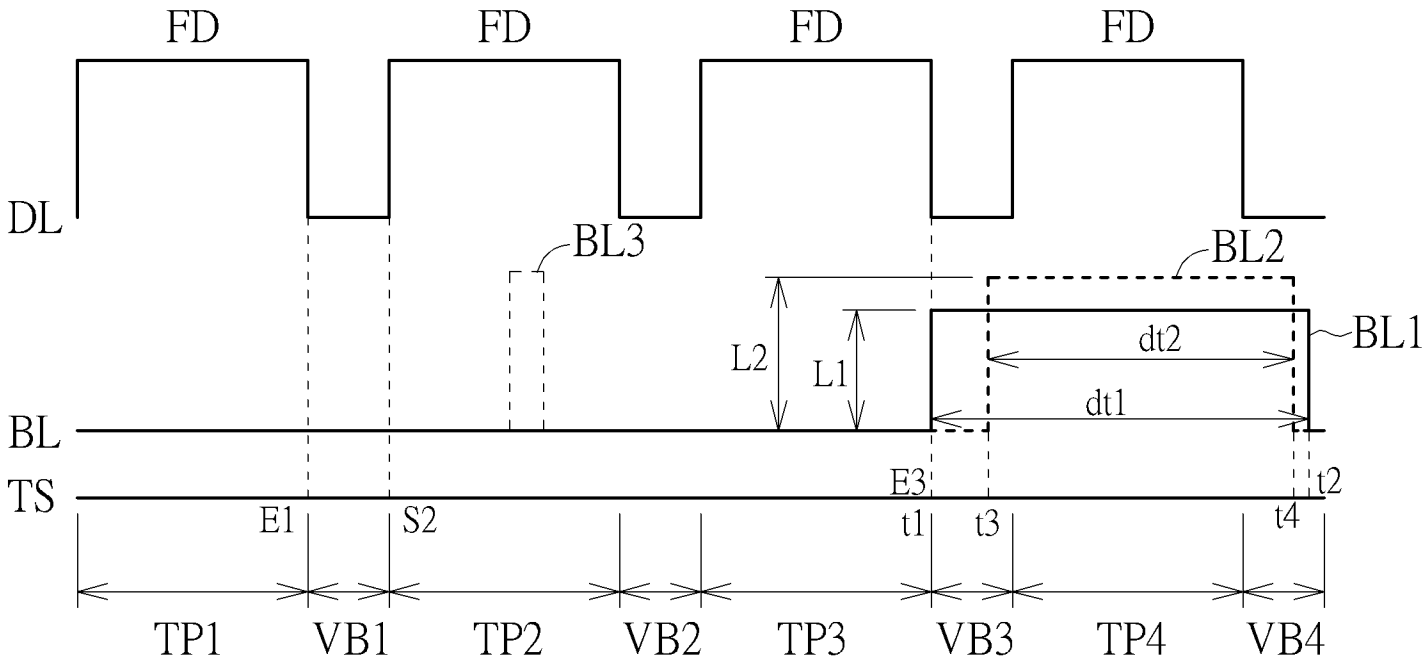
FIG. 4 is a time sequence diagram for displaying images by a displaying method according to the invention.
Figure 5:
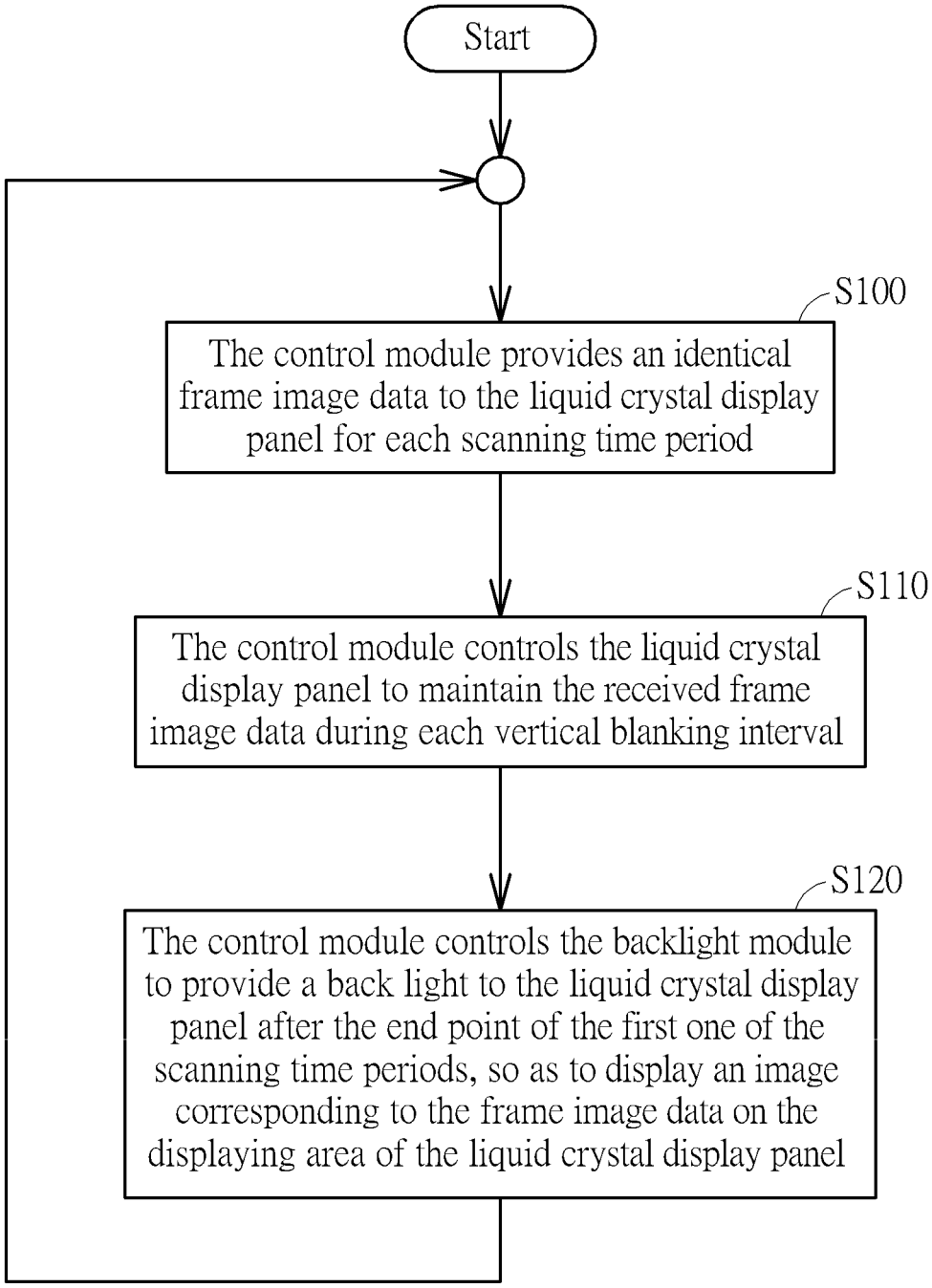
FIG. 5 is a flow chart of the displaying method.

Please refer to FIG. 1 to FIG. 5. FIG. 1 is a schematic diagram illustrating a displaying apparatus 1 of an embodiment according to the invention. FIG. 2 is a sectional view of the displaying apparatus 1 along the line X-X in FIG. 1. FIG. 3 is a function block diagram of the displaying apparatus 1. FIG. 4 is a time sequence diagram for displaying images by a displaying method according to the invention. FIG. 5 is a flow chart of the displaying method. The displaying apparatus 1 includes a casing 10, a control module 12, a liquid crystal display panel 14, and a backlight module 16. The control module 12, the liquid crystal display panel 14, and the backlight module 16 are disposed in the casing 10. The control module 12 is electrically connected (indicated by dashed lines in FIG. 2) to the liquid crystal display panel 14 and the backlight module 16. The liquid crystal display panel 14 has a displaying area 142 exposed through a window 10*a* of the casing 10. The control module 12 controls the liquid crystal display panel 14 and the backlight module 16 to display images on the displaying area 142 in scanning order (e.g. horizontally scanning indicated by arrows in FIG. 1). In practice, the control module 12 can be realized by a common control module of an LCD monitor, which includes a scaler 122, a memory 124, and a microcontroller 126 electrically connected to the scaler 122 and the memory 124. The control module 12 drives the liquid crystal display panel 14 to display images through the scaler 122, the operation details of which can be understood by referring to the operation of a common LCD in the field and will not be described further in details herein. The liquid crystal display panel 14 can be realized by, but not limited to a common liquid crystal display panel. In the embodiment, the liquid crystal display panel 14 has two transparent plate substrates 140*a* and 140*b*, two electrode layers (skipped in FIG. 2 for simplification and electrically connected with a driving circuit, also skipped in FIG. 2) oppositely disposed on the two substrates 140*a* and 140*b* respectively, and liquid crystals 140*c* disposed between the two substrates 140*a* and 140*b*. The liquid crystals 140*c* are divided into a plurality of cells. By controlling the electric field applied to each cell by the control module 12, the liquid crystals 140*c* in each cell can be arranged individually, so that the liquid crystal display panel 14 can selectively allow light to pass through. Therefore, in the embodiment, the displaying area 142 is defined as the extent of the liquid crystal display panel 14 displaying images.

The backlight module 16 is disposed adjacent to the liquid crystal display panel 14 for providing the light. In practice, the backlight module 16 can be realized by, but not limited to a common backlight module for a common liquid crystal display panels, such as edge-lit backlight modules and back-lit backlight modules. In the embodiment, the backlight module 16 is an edge-lit backlight module and includes a light guiding plate 162 (usually provided with optical films thereon), disposed adjacent to one of the transparent plate substrates 140*a* and 140*b*, and a light source 164, disposed adjacent to an edge side 162*a* of the light guiding plate 162. The light source 164 is a light bar (including a circuit board with a plurality of light-emitting diode devices electrically mounted thereon; therein, the circuit board includes a driving circuit for driving the light-emitting diode devices). In practice, the light source 164 can be replaced with a cold-cathode fluorescent lamp or other device capable of providing light. The control module 12 controls the light source 164 to selectively emit light through the driving circuit, for example but not limited to by powering the light source 164 for emitting light and turning off the light source 164 for not emitting light. The light enters the light guiding plate 162 from the edge side 162*a* and then emits out of a plan side 162*b* of the light guiding plate 162 toward the liquid crystal display panel 14, so that the backlight module 16 provides a surface light to the liquid crystal display panel 14. Furthermore, in the embodiment, the liquid crystal display panel 14 and the backlight module 16 are fixed by a plastic frame 11. Steps for displaying images by the displaying apparatus 1 according to the invention which will be described in the following can be executed through a firmware, stored in the memory 124 of the control module 12, by the microcontroller 126 of the control module 12.

The displaying apparatus 1 displays images in accordance with a periodic time sequence TS. The periodic time sequence TS includes a plurality of scanning time periods TP1 to TP4 and a plurality of vertical blanking intervals VB1 to VB4 staggered with the scanning time periods TP1 to TP4; that is, one vertical blanking interval VB1 to VB4 follows one scanning time periods TP1 to TP4. The embodiment is based on a periodic time sequence that includes four periodic subsets (each of which includes one scanning time period and one vertical blanking interval) , but the invention is not limited thereto. For example, the periodic time sequence can include less or more scanning time periods and vertical blanking intervals. As shown by FIG. 4, The periodic time sequence TS includes the first one TP1 of the scanning time periods TP1 to TP4, the first one VB1 of the vertical blanking intervals VB1 to VB4, the second one TP2 of the scanning time periods TP1 to TP4, the second one VB2 of the vertical blanking intervals VB1 to VB4, the third one TP3 of the scanning time periods TP1 to TP4, the third one VB3 of the vertical blanking intervals VB1 to VB4, the fourth one TP4 of the scanning time periods TP1 to TP4, and the fourth one VB4 of the vertical blanking intervals VB1 to VB4 in order, and repeats the above.

Based on an image data time sequence DL shown in FIG. 4, the control module 12 according to the displaying method provides a substantially identical frame image data FD to the liquid crystal display panel 14 for each scanning time period TP1 to TP4, as shown by the step S100 in FIG. 5. Therein, in practice, the control module 12 provides the frame image data FD to the liquid crystal display panel 14 repeatedly (i.e. for the four scanning time periods TP1 to TP4), so the substantially identical frame image data FD means that the four frame images received by the liquid crystal display panel 14 from the control module 12 for the four scanning time periods TP1 to TP4 can be exactly identical or have slight differences between each other, which is also applied to the following and will not be repeated in addition. The control module 12 controls the liquid crystal display panel 14 to maintain the received frame image data FD during each vertical blanking interval VB1 to VB4, as shown by the step S110. In the embodiment, because substantially the same frame image data FD is provided for each scanning time period TP1 to TP4, the liquid crystal display panel 14 maintains substantially the same frame image data FD from an end point El of the first one TP1 of the scanning time periods TP1 to TP4. In logic, the frame image data FD has been scanned completely within the first one TP1 of the scanning time periods TP1 to TP4. The scanning for the following scanning time periods TP2 to TP4 is just repeatedly scanning the frame image data FD. Concurrently, based on a back light time sequence BL shown in FIG. 4, the control module 12 according to the displaying method controls the backlight module 16 to provide a back light BL1 to the liquid crystal display panel 14 after the end point E1 of the first one TP1 of the scanning time periods TP1 to TP4, so as to display an image corresponding to the frame image data FD on the displaying area 142, as shown by the step S120. Afterwards, the displaying method repeats the above steps S100 to S120 for displaying an image during a next period sequence.

Furthermore, the back light BL1 is provided after the liquid crystal cells of the liquid crystal display panel 14 have switched statuses, which can avoid blurs on the image. In practice, under an acceptable criterion, the liquid crystal cell of which the completion of status switching reaches a certain percentage can be regarded as being stable. A time required for switching the status of a liquid crystal cell (e.g. switching from a fully open status to a fully closed status) is defined as a liquid crystal response time. If the time length of one scanning time period (e.g. the first one TP1 of the scanning time periods TP1 to TP4) is obviously shorter than the liquid crystal response time, back light will not be provided during the first one TP1 of the scanning time periods TP1 to TP4 in principle. This is because the liquid crystal cells of the liquid crystal display panel 14 are not stable, even not close to a stable status in the meanwhile. In the embodiment, the back light BL1 is provided from a first time point t1 within the periodic time sequence TS by the backlight module 16 under control of the control module 12. The first time point t1 is located at an end point E3 of the third one TP3 of the scanning time periods TP1 to TP4 and is far beyond a half of the periodic time (i.e. the time sum of the scanning time periods TP1 to TP4 and the vertical blanking intervals VB1 to VB4). For most situations, a time difference dt1 between the end point E1 and the first time point t1 is longer than the liquid crystal response time, so a user can watch the image almost without blurs on the displaying area 142; however, the invention is not limited thereto. For example, even in a case that the first time point t1 is not beyond a half of the periodic time, the user still can watch the image without blurs if the time difference dt1 is still larger than the liquid crystal response time.

Furthermore, in the embodiment, the first time point t1 is located at the end point E3 of the third one TP3 of the scanning time periods TP1 to TP4 (i.e. an start point of the third one VB3 of the vertical blanking intervals VB1 to VB4). The back light BL1 exists till a second time point t2 within the fourth one VB4 of the vertical blanking intervals VB1 to VB4. Thereby, the back light BL1 continues one scanning time period (TP4) and one vertical blanking interval (VB3) at least. In another aspect, the back light BL1 is provided from the end point E3 of the penultimate one of the scanning time periods TP1 to TP4 (i.e. the third one TP3 of the scanning time periods TP1 to TP4). In practice, the control module 12 also can control the backlight module 16 to provide the back light BL after the end point E3 of the penultimate one of the scanning time periods TP1 to TP4 (i.e. the third one TP3 of the scanning time periods TP1 to TP4). In addition, in the embodiment, the second time point t2 is located within the fourth one VB4 of the vertical blanking intervals VB1 to VB4. In practice, the second time point t2 can be shifted to an end point of the last vertical blanking interval (i.e. the fourth one VB4 of the vertical blanking intervals VB1 to VB4), i.e. the end of the current period sequence.

Furthermore, in the embodiment, the back light BL1 has a light intensity L1. The light intensity L1 is adjustable. When the brightness of an image is insufficient, the light intensity L1 can be increased. For a case without changing the brightness of an image, the light intensity L1 can be increased with shortening the duration of the back light BL1 (i.e. the time difference between the first time point t1 and the second time point t2). In practice, an adjustment to the light intensity L1 can be set by the user or automatically executed in coordination with the extent of the back light BL1. For example, as shown by FIG. 4, the control module 12 controls the backlight module 16 to provide the back light BL1 from the first time point t1 to the second time point t2 within the periodic time sequence TS. Under a condition of unchanging the brightness of an image, the back light BL1 is adjusted to a back light BL2 (shown in dashed lines). Therein, the back light BL2 is provided from a time point t3 to a time point t4. A light intensity L2 of the back light BL2 is higher than the light intensity L1. A product of the light intensity L1 and the time difference dt1 between the first time point t1 and the second time point t2 is equal to a product of the light intensity L2 and a time difference dt2 between the time point t3 and the time point t4. In other words, the product of the light intensity L1 and the time difference dt1 between the first time point t1 and the second time point t2 (or the light intensity L2 and the time difference dt2 between the time point t3 and the time point t4) remains a predetermined value. However, the invention is not limited thereto. In addition, In general, Under a condition that the brightness of an image is satisfied, a delay of the first time point t1 is conducive to providing the back light BL1 after the liquid crystal cells of the liquid crystal display panel 14 are stable. In addition, the light intensity L1 and the time difference dt1 can be independently adjusted by the user, which can reduce the blurs and also meet a brightness requirement. Furthermore, in practice, the control module 12 controls the backlight module 16 to also provide another back light BL3 (shown in dashed lines in FIG. 4) separate from the back light BL1 after the end point E1 of the first one TP1 of the scanning time periods TP1 to TP4, which is conductive to enhancement of the brightness.

It is added that if the first time point t1 is located at the end point E1 of the first one TP1 of the scanning time periods TP1 to TP4, because some liquid crystal cells of the liquid crystal display panel 14 corresponding to an area of the displaying area 142 (i.e. the area of the displaying area 142 corresponding to the scanning close to the end point E1) maybe have not switched to a stable status at the first time point t1, the image displayed on said area of the displaying area 142 (i.e. the bottom area of the displaying area 142 as the of the displaying area 142 is horizontally scanned) may involve blurs after the back light BL1 is provided. For solving this problem of blurs, it is practicable to provide the back light BL1 after a start point S2 of the second one TP2 of the scanning time periods TP1 to TP4. For example, as the first time point t1 is located at the start point S2, during the first one VB1 of the vertical blanking intervals VB1 to VB4, the above liquid crystal cells having not switched to the stable status can keep switching till to the stable status before of the appearance of the back light BL1, so that the blurs disappear when the back light BL1 appears. Even though there are some un-switched liquid crystal cells left, the amount of the un-switched liquid crystal cells is decreased and therefore, the influence of blurs is reduced.

Figure 6:
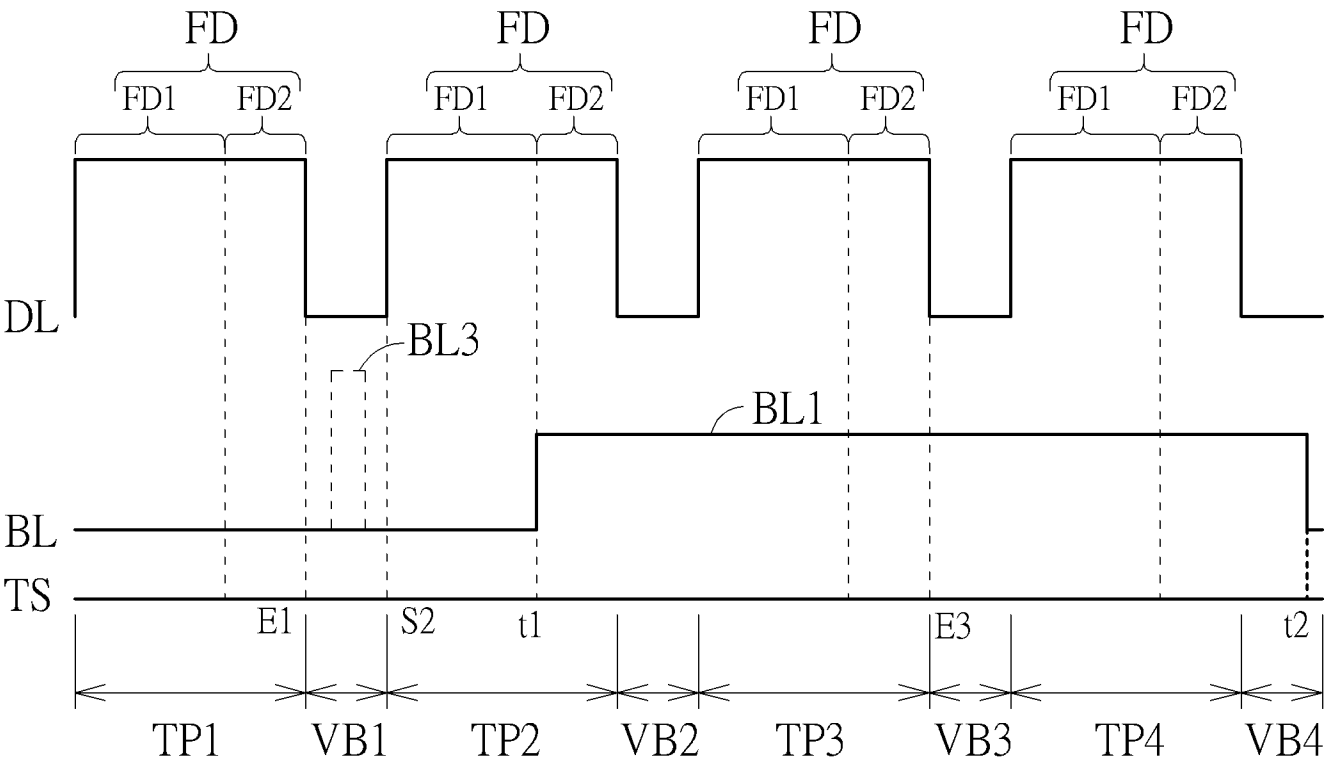
FIG. 6 is a time sequence diagram for displaying images by the displaying method according to another embodiment.
Figure 7:
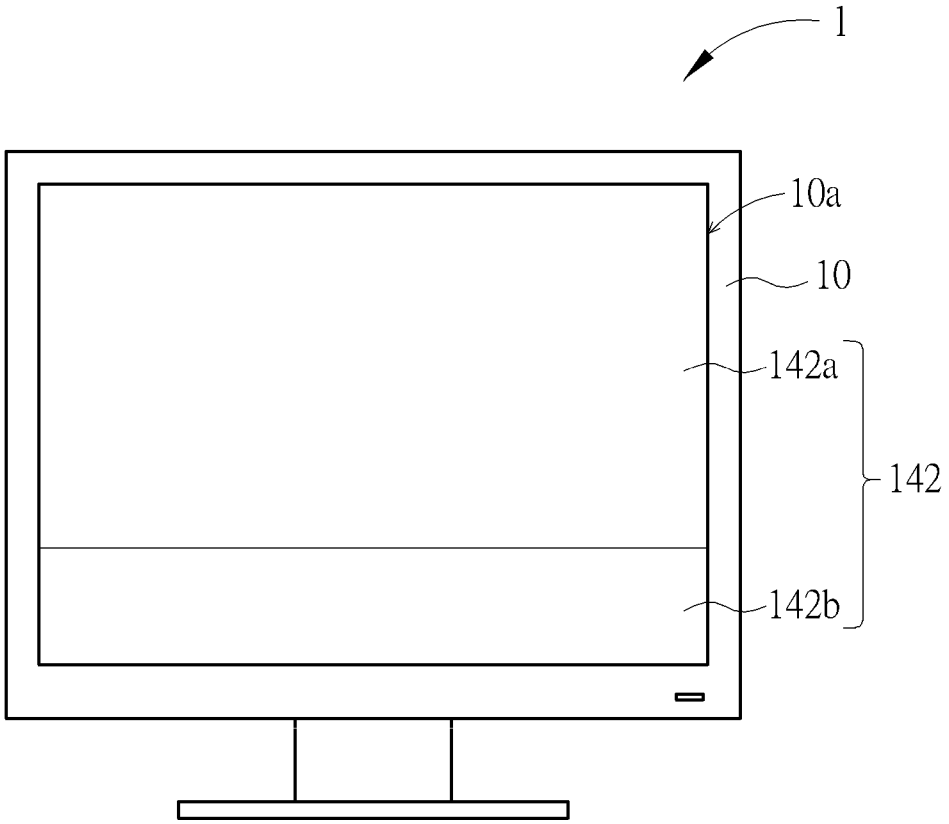
FIG. 7 is a front view of the displaying apparatus in FIG. 1 that displays images on a displaying area of a liquid crystal display panel of the displaying apparatus.

Furthermore, when the displaying apparatus 1 is used in practical application, successive image frames displayed on the displaying area 142 by the liquid crystal display panel 14 may contains a dynamic image portion and a static image portion for each image frame. For example, for an on-line game, its image displaying is executed in an upper portion and a lower portion. The upper portion shows real-time images (e.g. movements of roles, interaction between the roles, and so on), which are of dynamic images; the lower portion shows information about the roles for gamers (e.g. capabilities of the roles, messages between the roles, information about the game system, and so on), which are of static images. In general, the color of pixels changes relatively greatly for displaying dynamic images, which induces blurs easily. On the contrary, the color of pixels changes relatively slightly for displaying static images, in which blurs are ignored easily by the gamers. Therefore, the start point (i.e. the first time point t1) when the back light BL1 is provided can be determined according to this feature, so that the start point can be advanced for lengthening the extent of the back light BL1 (also enhancing the brightness of images) under tolerance of blurs involved in static images. Please refer to FIG. 6 and FIG. 7. FIG. 6 is a time sequence diagram for displaying images by the displaying method according to another embodiment. FIG. 7 is a front view of the displaying apparatus 1 for illustrating image displaying of the displaying area 142. In the embodiment, the frame image data FD includes a first image data segment FD1 and a second image data segment FD2 next to the first image data segment FD1. The displaying area 142 includes a first area 142*a* and a second area 142*b* adjacent to the first area 142*a* in scanning order. The first image data segment FD1 corresponds to a relatively dynamic image. The second image data segment FD2 corresponds to a relatively static image. The start point (i.e. the first time point t1) when the control module 12 controls the backlight module 16 to provide the BL1 corresponds to the second image data segment FD2 (or the start point of the second image data segment FD2). In the embodiment, a user can watch the relatively dynamic image corresponding to the first image data segment FD1 displayed on the first area 142*a* by the liquid crystal display panel 14, and the relatively static image corresponding to the second image data segment FD2 displayed on the second area 142*b* by the liquid crystal display panel 14. Even though some liquid crystal cells of the liquid crystal display panel 14 are not stable completely when the back light BL1 appears, because most of these liquid crystal cells are located at the lower (e.g. corresponding to the second area 142*b*) and the images displayed on the second area 142*b* are relatively static images, the image change is slight and the influence of induced image blurs to the user is also slight. Furthermore, even though some liquid crystal cells of the liquid crystal display panel 14 corresponding to the first area 142*a* are not stable completely when the back light BL1 appears, because these liquid crystal cells take a small proportion of the whole liquid crystal cells corresponding to the first area 142*a*, the influence of image blurs induced by these un-stabilized liquid crystal cells to the user is also slight relative to the image corresponding to the whole first area 142*a*.

It is added that in the embodiment, the first time point t1 is located within the second one TP2 of the scanning time periods TP1 to TP4; however, the invention is not limited thereto. Furthermore, in the embodiment, when the time pointer of the periodic time sequence TS arrives the first time point t1, the liquid crystal cells corresponding to the first area 142*a* have operated at least for one scanning time period and one vertical blanking interval (i.e. for a quarter of the periodic time). If the liquid crystal response time is short enough (e.g. by well-known techniques for shortening the liquid crystal response time), for example, shorter than a quarter of the periodic time of the embodiment, the liquid crystal cells corresponding to the first area 142*a* are stable at the first time point t1, so that no blurs occur on the relatively dynamic image displayed on the first area 142*a* in principle. In practice, if the first time point t1 is set to be located within the third one TP3 of the scanning time periods TP1 to TP4, the liquid crystal cells corresponding to the first area 142*a* have operated at least for two scanning time periods and two vertical blanking intervals (i.e. for a half of the periodic time), which facilitates the achievement of the liquid crystal cells corresponding to the first area 142*a* being in a stable status, so as to provide the user relatively dynamic images without blurs. It is added that based on the feature that the influence of blurs in a relatively static image to the user is relatively slight, in practice, if an upper portion from the beginning of the displaying area 142 is also used for displaying relatively static images thereon, the second time point t2, at which the back light BL1 is turned off, can be delayed to the first one TP1 of the scanning time period TP1 to TP4 of the next periodic time sequence TS but before the ending of scanning image data of the relatively static image displayed on the upper portion of the displaying area 142. Thereby, the brightness can be increased more. Furthermore, in practice, the control module 12 controls the backlight module 16 to provide another back light BL3 (shown in dashed lines in FIG. 6) separate from the back light BL1 after the end point El of the first one TP1 of the scanning time periods TP1 to TP4, which is conductive to enhancement of the brightness.

In addition, it is added that in the above embodiments, the control module 12 provides substantially the same frame image data FD to the liquid crystal display panel 14 in single period time sequence (i.e. during the scanning time periods TP1 to TP4) in principle; however, the invention is not limited thereto. For an example, based on the periodic time sequence TS shown by FIG. 4, the control module 12 provides a substantially identical frame image data to the liquid crystal display panel 14 during the scanning time periods TP3 and TP4 and provides other frame images data to the liquid crystal display panel 14 during the scanning time periods TP1 and TP2. In this case, the scanning time period TP3 can be regarded as a first scanning time period, the vertical blanking interval VB3 can be regarded as a vertical blanking interval after the first scanning time period, and the scanning time period TP4 can be regarded as a second scanning time period after the vertical blanking interval. Therein, the control module 12 provides the substantially identical frame image data for the first scanning time period and the second scanning time period and provides the back light BL1 after the end point of the first scanning time period. For another example, still based on the periodic time sequence TS shown by FIG. 4, the control module 12 provides a substantially identical frame image data to the liquid crystal display panel 14 during the scanning time periods TP1 and TP4 and provides other frame image data to the liquid crystal display panel 14 during the scanning time periods TP2 and TP3. In this case, the scanning time period TP1 can be regarded as a first scanning time period, the vertical blanking interval VB1, VB2 or VB3 can be regarded as a vertical blanking interval after the first scanning time period, and the scanning time period TP4 can be regarded as a second scanning time period after the vertical blanking interval. Therein, the control module 12 provides the substantially identical frame image data for the first scanning time period and the second scanning time period and provides the back light BL1 after the end point of the first scanning time period. The relevant descriptions about the back lights BL1, BL2 and BL3 and the frame image data FD (e.g. the adjustment to the backlight intensity, the amount of the back lights, the division of the frame image data into the image data segments according to dynamic and static images, and so on) for the embodiments in the foregoing paragraphs are also applied to the embodiments in this paragraph and will not repeated.

Based on a practical case, the display frequency of the liquid crystal display panel 14 shown in FIG. 4 is 240 Hz. The control module 12 provides the substantially identical frame image data to the liquid crystal display panel 14 during the scanning time periods TP1 and TP4, so that a display frequency the user senses is 60 Hz. Similarly, if the display frequency of the liquid crystal display panel 14 is 120 Hz. The control module 12 provides the substantially identical frame image data to the liquid crystal display panel 14 during the scanning time periods TP1 and TP2, so that a display frequency the user senses also is 60 Hz.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A displaying method for displaying images on a liquid crystal display panel of a displaying apparatus in accordance with a periodic time sequence, the displaying apparatus further comprising a control module, electrically connected to the liquid crystal display panel, and a backlight module, electrically connected to the control module and disposed adjacent to the liquid crystal display panel, the periodic time sequence comprising a plurality of scanning time periods and a plurality of vertical blanking intervals staggered with the scanning time periods, the displaying method comprising the following steps:

providing a substantially identical frame image data by the control module to the liquid crystal display panel for each scanning time period in the periodic time sequence; and providing a first back light by the backlight module, during the periodic time sequence, to the liquid crystal display panel only after at least one scanning time period and vertical blanking interval has ended and after a first time point within the periodic time sequence after an end point of a first one of the scanning time periods, and a time difference between the end point of the first one of the scanning time periods and the first time point is longer than a liquid crystal response time.

2. The displaying method of claim 1, wherein the first back light has a light intensity, and the light intensity is adjustable.

3. The displaying method of claim 2, wherein the first back light is provided by the backlight module from the first time point to a second time point within the periodic time sequence, and a product of the light intensity and a time difference between the first time point and the second time point remains a predetermined value.

4. The displaying method of claim 1, wherein the first back light is provided by the backlight module from the first time point within the periodic time sequence, the frame image data comprises a first image data segment and a second image data segment next to the first image data segment in scanning order, the first image data segment corresponds to a relatively dynamic image, the second image data segment corresponds to a relatively static image, and the first time point corresponds to the second image data segment.

5. The displaying method of claim 1, wherein the first back light is provided by the backlight module after an end point of the penultimate one of the scanning time periods.

6. The displaying method of claim 1, further comprising the following step:

providing a second back light separate from the first back light by the backlight module to the liquid crystal display panel after the end point of the first one of the scanning time periods.

7. A displaying apparatus for displaying images in accordance with a periodic time sequence, the periodic time sequence comprising a plurality of scanning time periods and a plurality of vertical blanking intervals staggered with the scanning time periods, the displaying apparatus comprising a liquid crystal display panel having a displaying area;

a backlight module disposed adjacent to the liquid crystal display panel; and a control module electrically connected to the liquid crystal display panel and the backlight module, the control module providing a substantially identical frame image data to the liquid crystal display panel for each scanning time period in the periodic time sequence and controlling the backlight module to provide a first back light to the liquid crystal display panel, during the periodic time sequence, only after at least one scanning time period and vertical blanking interval has ended and after a first time point within the periodic time sequence after an end point of a first one of the scanning time periods, and a time difference between the end point of the first one of the scanning time periods and the first time point is longer than a liquid crystal response time, so as to display an image corresponding to the frame image data on the displaying area, wherein the first back light has a light intensity, and the light intensity is adjustable.

8. The displaying apparatus of claim 7, wherein the control module controls the backlight module to provide the first back light from the first time point to a second time point within the periodic time sequence, and a product of the light intensity and a time difference between the first time point and the second time point remains a predetermined value.

9. The displaying apparatus of claim 7, wherein the control module controls the backlight module to provide the first back light from the first time point within the periodic time sequence, the displaying area comprises a first area and a second area adjacent to the first area in scanning order, the frame image data comprises a first image data segment and a second image data segment next to the first image data segment in scanning order, the liquid crystal display panel displays a relatively dynamic image corresponds to the first image data segment on the first area, the liquid crystal display panel displays a relatively static image corresponds to the second image data segment on the second area, and the first time point corresponds to the second image data segment.

10. The displaying apparatus of claim 7, wherein the control module controls the backlight module to provide the first back light after an end point of the penultimate one of the scanning time periods.

11. The displaying apparatus of claim 7, wherein the control module controls the backlight module to provide a second back light separate from the first back light to the liquid crystal display panel after the end point of the first one of the scanning time periods.

12. A displaying method for displaying images on a liquid crystal display panel of a displaying apparatus in accordance with a periodic time sequence, the displaying apparatus further comprising a control module, electrically connected to the liquid crystal display panel, and a backlight module, electrically connected to the control module and disposed adjacent to the liquid crystal display panel, the periodic time sequence comprising a first scanning time period, a vertical blanking interval after the first scanning time period, and a second scanning time period after the vertical blanking interval in order, the displaying method comprising the following steps:

providing a substantially identical frame image data by the control module to the liquid crystal display panel for the first scanning time period and the second scanning time period in the periodic time sequence; and providing a first back light by the backlight module to the liquid crystal display panel, during the periodic time sequence, only after at least one scanning time period and vertical blanking interval has ended and after a first time point within the periodic time sequence after an end point of a first one of the scanning time periods, and a time difference between the end point of the first one of the scanning time periods and the first time point is longer than a liquid crystal response.

13. The displaying method of claim 12, wherein the first back light has a light intensity, and the light intensity is adjustable.

14. The displaying method of claim 13, wherein the first back light is provided by the backlight module from the first time point to a second time point within the periodic time sequence, and a product of the light intensity and a time difference between the first time point and the second time point remains a predetermined value.

15. The displaying method of claim 12, wherein the first back light is provided by the backlight module from the first time point within the periodic time sequence, the frame image data comprises a first image data segment and a second image data segment next to the first image data segment in scanning order, the first image data segment corresponds to a relatively dynamic image, the second image data segment corresponds to a relatively static image, and the first time point corresponds to the second image data segment.

16. The displaying method of claim 12, further comprising the following step:

providing a second back light separate from the first back light by the backlight module to the liquid crystal display panel.

17. The displaying method of claim 16, wherein light intensity of the second back light is higher than light intensity of the first back light.

* * * * *